US007562614B2

(12) United States Patent
Polston

(10) Patent No.: US 7,562,614 B2
(45) Date of Patent: Jul. 21, 2009

(54) CLOSED BOLT SYSTEM WITH TRIGGER ASSEMBLY FOR CONVERTING A FULLY AUTOMATIC SUBMACHINE GUN INTO A SEMI-AUTOMATIC CARBINE

(75) Inventor: Timothy J. Polston, Jacksonville, AR (US)

(73) Assignee: SA Ordinance, LLC, Tierra Verde, FL (US)

( * ) Notice: Subject to any disclaimer, the term of this patent is extended or adjusted under 35 U.S.C. 154(b) by 436 days.

(21) Appl. No.: 11/435,402

(22) Filed: May 17, 2006

(65) Prior Publication Data

US 2007/0266845 A1 Nov. 22, 2007

(51) Int. Cl.
*F41A 5/00* (2006.01)
*F41A 3/00* (2006.01)

(52) U.S. Cl. ..... 89/139; 89/144; 89/145; 89/150; 89/154; 42/69.03

(58) Field of Classification Search ..... 89/139, 89/144, 145, 150, 154; 42/69.02, 69.03
See application file for complete search history.

(56) References Cited

U.S. PATENT DOCUMENTS 1,073,452 A * 9/1913 White ..... 89/144
1,131,319 A 3/1915 Blish
2,117,218 A * 5/1938 Sanders ..... 89/144
2,390,061 A * 12/1945 Eklund ..... 89/145
2,855,716 A * 10/1958 Campbell ..... 89/144
3,264,939 A * 8/1966 Reising ..... 89/145
3,292,492 A 12/1966 Sturtevant
3,577,827 A * 5/1971 Billett et al. ..... 89/145
3,774,500 A * 11/1973 Into ..... 89/190
3,845,688 A * 11/1974 Seecamp ..... 89/146
4,017,996 A * 4/1977 Liedke ..... 89/144
4,057,003 A * 11/1977 Atchisson ..... 89/138
4,128,042 A * 12/1978 Atchisson ..... 89/138
4,185,537 A * 1/1980 Hayashi ..... 89/145
4,308,786 A * 1/1982 Hayashi ..... 89/145
4,358,986 A 11/1982 Giorgio
4,522,106 A * 6/1985 Sullivan ..... 89/140
4,553,469 A * 11/1985 Atchisson ..... 89/191.02
4,693,170 A * 9/1987 Atchisson ..... 89/149
4,893,547 A * 1/1990 Atchisson ..... 89/187.01
5,183,959 A * 2/1993 McCoan et al. ..... 89/148
5,274,939 A * 1/1994 Scaramucci et al. ..... 42/69.03

(Continued)

*Primary Examiner*—Michael Carone
*Assistant Examiner*—Jonathan C Weber
(74) *Attorney, Agent, or Firm*—James E. Larson; Larson & Larson, P.A.

(57) ABSTRACT

A closed bolt system with a trigger assembly for converting an open bolt, blowback type submachine gun into a single firing carbine is provided. The closed bolt system with trigger assembly includes a tensioned trigger member supporting a tensioned disconnector system. A tensioned sear interacts with the disconnector system and a tensioned hammer. The hammer strikes a firing pin in the bolt when it is released from the sear. The blowback of the bolt, as a result of expanding gases from the exploding and exiting round, re-cocks the hammer by re-engaging the sear with the hammer and disengages the sear from the disconnector system. Only after releasing the trigger will the sear re-engage with the disconnector system and thereby permit another round to be fired. A receiver having a cavity encloses the bolt and prohibits a fully automatic bolt to be used therewith.

22 Claims, 12 Drawing Sheets

U.S. PATENT DOCUMENTS 5,501,134 A 3/1996 Milazzo et al.
5,623,114 A 4/1997 Soper
5,697,178 A * 12/1997 Haskell ..... 89/144
5,770,814 A * 6/1998 Ealovega ..... 89/131
6,615,527 B1 * 9/2003 Martin ..... 42/69.03
7,261,029 B1 * 8/2007 Davis ..... 89/148
7,398,723 B1 * 7/2008 Blakley ..... 89/129.01
2007/0266845 A1 * 11/2007 Polston ..... 89/139

* cited by examiner

CLOSED BOLT SYSTEM WITH TRIGGER ASSEMBLY FOR CONVERTING A FULLY AUTOMATIC SUBMACHINE GUN INTO A SEMI-AUTOMATIC CARBINE

BACKGROUND OF THE INVENTION

1. Field of Invention

The present invention relates to a gun trigger assembly. More particularly, it relates to a trigger assembly for installation into a submachine gun for converting said gun from a fully automatic to a semi-automatic firing weapon and which further prohibits said semi-automatic firing weapon from being converted back to a fully automatic firing weapon.

2. Description of the Prior Art

Machine guns are well known in the prior art. Their history can be traced back to 1718 when James Puckle invented what he called the "Defence Gun" which mounted on a tripod and included a large revolver with a cylinder behind a single barrel. The cylinder was turned manually and it could fire 63 shots in seven minutes.

The American Civil War saw more advancement in the art when Wilson Agar produced the Coffee Mill gun for the Union Army. This gun had a wheeled frame carrying 24 rifle barrels. Once the gun was loaded, a single percussion cap was placed on a nipple on the iron frame and fired by a hammer. The flash passing through the frame ignited all 24 cartridges.

Thereafter, Richard Gatling invented the infamous "Gatling Gun" made up of six barrels mounted in a revolving frame. This weapon was first used by the United States Army and subsequently by most major armies of Europe.

Inspired by the success of the Gatling Gun, others were encouraged to enter this emerging field of weapon production. In 1879 the Gardner machine gun was shown for the first time. This weapon had two-barrels that were operated by a crank which loaded and fired each barrel in turn. The feed system was a grooved strip into which the rims of a box of cartridges could be slid, after which the box was removed. This gun could fire up to 10,000 rounds in less than 30 minutes.

Finally, a weapon thought to be the grandfather of all modern machine guns was introduced by Hiram Maxim in 1885. He used the energy of each bullet's recoil force to eject the spent cartridge and insert the next bullet, a general principle still used today in the art. The Maxim machine gun could fire until an entire belt of bullets was used up, thereby discharging upwards of 500 rounds per minute. The success of this invention inspired other inventions and improvements upon machine guns such as the German Army's Maschinengewehr and the Russian Pulemyot Maxima which were both based on Maxim's invention. The advent of the Maxim machine gun eclipsed manually operated "crank" style mechanical guns and set the stage for later developments.

By the outbreak of the First World War in 1914, the machine gun was an integral part of all warring nations. But most were still mounted upon tripods, carts or vehicles and required more than one operator. Improvements were therefore still needed and desired. The idea of a single operator weapon, a so called "machine rifle," which could fire a high volume of bullets was desired by the World's armies. Attempts to produce such a weapon were being made during WWI, but with limited success. One such example is the Browning Automatic Rifle or "BAR" developed by John Browning in 1917. The BAR was a gas-operated, air-cooled, magazine-fed weapon. It chambered the standard service round of that period, the .30-06 Springfield. It weighed about 16 to 19 pounds empty, depending upon the model. The magazine was a detachable box-type with a capacity of only 20 rounds. It was used by the US military through the Korean War where it served as a squad's light machine gun. It could be mounted on bi-pod or shot from a hip or shoulder position. Frequently, an assistant would carry extra ammunition for the operator. However, the assistant was not needed to fire the weapon. And, like other emerging single operator machine guns that could be carried by one person, the barrel was fixed. Although effective, its long profile left much to be desired in a more convenient weapon for WWI and a need existed for a better single operator machine gun.

General John Thompson wished to address this need and set out to build a different type of gun, one that is now referred to as a submachine gun. The designs of such weapons came from a desire to make a machine pistol, one that didn't use rifle rounds. Pistol designs had seen the advent of highly reliable weapons such as the 1911 design for the .45 caliber, used extensively by the US military at that time and for another 80 years thereafter.

Thompson knew that the heart of any machine gun lied in its breech locking and feeding mechanisms. Thompson was well aware of the designs used in other guns of the day, but none was appropriate for his design. Recoil actuated systems were popular in the heavy and medium machine guns of the era, but these used many moving parts that were heavy and prone to failure. The Recoil system uses the rearward thrust of a movable barrel to unlock the breech, eject the spent cartridge case, insert a fresh cartridge, re-lock the breech and fire the next round. Gas actuated systems had many of the same drawbacks as recoil systems. A gas system employs a small vent hole drilled into the barrel that bleeds off some of the high pressure gasses that propel the bullet out through the barrel. The vented gas pressure is routed back to the breech area where it drives a piston that performs the same unlocking, ejection, loading, re-locking and firing sequence as a recoil operated gun. The third system, used mostly in semi-automatic handguns, such as the 1911 pistol, employed a technique referred to as "Blowback." These guns relied on the propellant gas pressure to literally 'blow' the bolt rearward. This action powered the sequence of ejecting and loading the next round. Guns using the blowback process are simple because they do not have a locking breech. They depend on the forward inertia of a heavy bolt, driven by a recoil spring, to keep the breech closed at the point of peak chamber pressure. The blowback system seemed to be the ideal choice for use in a lightweight machine gun because of its simplicity, lack of heavy moving parts and reliability. But in practice, it is only usable with low powered pistol ammunition, such as the .45 caliber. High power rifle ammunition creates much higher chamber pressure that overcomes any inertia in the bolt, blowing it back prematurely and thus causing cartridge cases to be ejected during peak pressure, exposing the operator to the hazards of ruptured brass and explosive gasses.

To solve this problem, Thompson sought to find a way to make a simple but practical breech lock. He uncovered across U.S. Pat. No. 1,131,319 to Blish entitled a "Breech Closure for Firearms." This is essentially a breech locking mechanism that could be used on a blowback operated firearm. The lock delays the blowback of the bolt until the chamber pressure has diminished to an acceptable level. This use lead to the final production of the Thompson Submachine Gun. This weapon uses a .45 caliber pistol round and can accept either a 100 or 50 round drum or a 30 or 20 round box magazine. The gun was originally nick-named the "Trench Broom" because it was envisioned by General Thompson that a single user rushing an entrenched position, like those of WWI, could attack and fire upon the entire trench, thereby inflicting a high rate of causalities, or "sweeping it clean." Although the US military was slow to accept the weapon, it finally ordered a small number of the weapons that arrived at the docks of New York just as WWI ended in 1918.

The gun underwent some changes and adaptations during the period between WWI and WWII, but its original design remained essentially the same. Federal enforcement agencies and local police forces began to use the Thompson during this period to combat organized crime. In fact, the United States Postal Service was one of the first purchasers of the Thompson Submachine Gun. When WWII came along, the US military finally realized the importance of such a weapon and more than one and one half million of the weapons were eventually produced. During WWII, methods were used to make the gun more cost effective to produce. But, the original design never really changed.

The Thompson Submachine Gun operates on a very simple principle. It is an open bolt weapon. That is, when the weapon is ready to fire, the bolt and working parts are held to the rear. When the trigger is pulled the bolt goes forward, feeding a round from the magazine into the chamber and firing it. Like any other self-loading design without an external power supply, the action is cycled by the energy of the exploding round; this sends the bolt back to the rear, ejecting the empty cartridge case and preparing for the next round. The expanding gas of the exploding cartridge fires the bullet and pushes the bolt backward against a recoil spring. So long as the trigger is pulled, a sear will not engage a small indent in the bolt and will continue permitting bullets to be fired in an automatic mode. Once the trigger is released, it acts upon the sear which catches the small indent and prevents the bolt from moving forward against a new cartridge.

It has been unlawful since 1934 (The National Firearms Act) for civilians to own any type of machine gun without special permission from the U.S. Treasury Department. This of course includes the Thompson. Machine guns are now subject to a $200 tax every time their ownership changes from one federally registered owner to another and the gun must be registered with the Bureau of Alcohol Tobacco and Firearms (BATF) in its National Firearms Registry. So long as a person follows this procedure, ownership of existing machine guns is legal. Newly manufactured machine guns however are no longer available for purchase by the general public even with BATF registration and payment of the Treasury tax. Only military and law enforcement can purchase such new weapons now.

Even though existing machine guns can be legally owned in the US, many people simply do not feel comfortable owning such a weapon, or are unfamiliar with the registration and tax process or can simply not afford the cost of a classic WWII firearm, such as the Thompson Submachine Gun. Accordingly, some companies offer replicas of these firearms. And in fact, a replica of the Thompson Submachine Gun, which only fires in a single fire mode, can be purchased. Karr Arms offers such a replica. Unfortunately, the quality of these replicas is extremely poor. Collectors of classic WWI and WWII era firearms are disinterested from owning these inferior replicas.

Accordingly, a need exists for a gun such as the Thompson Submachine Gun to be available to a collector of vintage firearms at a reduced cost. These guns should be available as a semi-auto carbine to avoid the cost of purchasing transferable Class III guns. Further, these guns, if converted from a fully automatic to a semi-automatic firing weapon, need to exist in their semi-automatic configuration such that they are not capable of being converted back to a fully automatic firing weapon unless converted from a registered Class III weapon.

SUMMARY OF THE INVENTION

I have invented a closed bolt system including a trigger assembly for installation into a fully automatic firing machine gun for converting said machine gun to a semi-automatic firing carbine. My closed bolt system with trigger assembly, in its preferred embodiment, is used with guns employing a blowback system, such as the Thompson Submachine Gun. My closed bolt system with trigger assembly can be used on a de-milled Thompson Submachine Gun parts kit that may be purchased without BATF approval. It is noted that the barrel length still may require registration and tax payment if a 10½ inch barrel is used (short barrel rifle). However, for example, if a Thompson using my closed bolt system with trigger assembly is an entire manufactured weapon or a converted de-milled Thompson using my parts kits with a 16 inch barrel, it would be classified by BATF as a rifle and be subject to those applicable laws.

My closed bolt system with trigger assembly employs a trigger, a disconnector arm, a disconnector, a sear that acts upon a spring loaded hammer for striking a firing pin of a bolt located within a semi-auto receiver of the gun. It is noted that the bolt and receiver of the fully automatic submachine gun, such as the Thompson, is not used with my closed bolt system to make it a semi-auto carbine.

The trigger assembly of my closed bolt system prohibits the gun from firing in a fully automatic mode and instead limits the gun to firing one bullet for every pull of the trigger (semi-auto). So long as bullets remain in the magazine or drum being used, the hammer will return to a ready fire position (cocked) when the bolt blows back.

When the closed system with trigger assembly of my invention is installed, a loaded magazine is attached to the gun. The bolt is drawn back manually against the recoil spring, cocking the hammer. A spring guide mounts behind the recoil spring to prevent it from wading up. A safety lever cam can be turned to draw the hammer off a sear away from the "ready fire" position and place it in "safe" mode. The bolt can be driven forward stripping a cartridge from the magazine or drum thereby loading it into the firing chamber of the gun. The safety lever is turned to "ready fire" for permitting a round to be shot (hammer re-engages sear). By pulling the trigger, an engagement between the trigger and the disconnector arm is released, thereby releasing an engagement between the disconnector arm and disconnector. This in turn affects an engagement between the disconnector and the sear which disengages the sear from the hammer. Accordingly, the hammer releases from its tensioned positioned and strikes a firing pin inside of the bolt. The firing pin slams against the primer of the cartridge and ignites the propellant of the cartridge.

Expanding gases from the explosion of the propellant forces the bullet out the end of the barrel of the gun. Due to the great weight differential between the bolt and the bullet, the bolt is driven back at a slower rate against the recoil spring than the bullet leaving the barrel, ejecting the spent casing and cocking the hammer. A lug on a front portion of the bolt passes over the disconnector arm depressing it and forcing the sear off a depressed position and allowing a sear spring to expand. As the bolt continues rearwardly, it depresses the hammer until a notch in the hammer passes a notch in the sear engaging each other. Once the bolt completely cycles, the hammer remains cocked even though the trigger is still in a depressed (pulled) position because it is held back by this notch-to-notch engagement with the sear. The bolt cycle completion also chambers another round. However, the trigger must be released and pulled again to fire another round in that the position of the disconnector under the sear must be reset. Hence, the weapon with my closed bolt system with trigger assembly is a semi-auto carbine.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERRED EMBODIMENT

Figure 1:
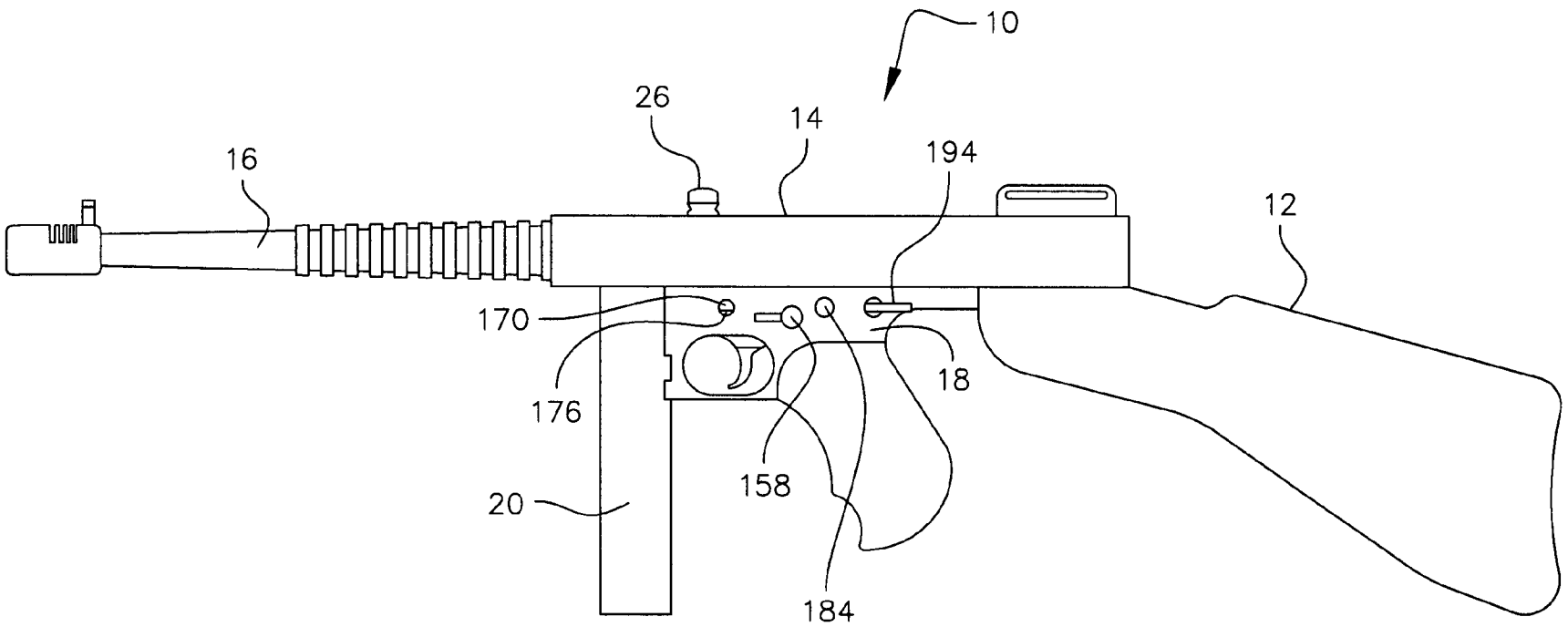
FIG. 1 is a side plan view of a submachine gun of which the closed bolt system with trigger assembly of the present invention can be installed to convert said submachine gun from a fully automatic to a semi-automatic firing weapon.

Referring to FIG. 1, a submachine gun 10 is shown. Gun 10 has a butt stock 12, a receiver 14, a barrel 16, a trigger housing 18 and a magazine 20. Gun 10 is typical of the design that can receive a closed bolt system with trigger assembly of the present invention to be more fully discussed hereinafter. Although the closed bolt system with trigger assembly could be installed in many different styles of guns, in its preferred embodiment, it is used with a Thompson Submachine Gun. For example, the closed bolt system with trigger assembly of the present invention can be used with a fully automatic Class III Thompson Submachine Gun. In such arrangement, only the trigger housing 18, butt stock 12, the sights, the safety lever and the original 10½ inch barrel are used. And if the 10½ inch barrel is used, the owner must obtain a short barrel rifle permit from BATF. However, if the owner buys a 16 inch barrel, then the short barrel rifle permit is not necessary. Or, an owner can buy a de-milled original fully automatic Thompson that is just unregulated parts (i.e., shipped to consumer with no receiver) and install the closed bolt system with trigger assembly of the present invention.

Figure 3:
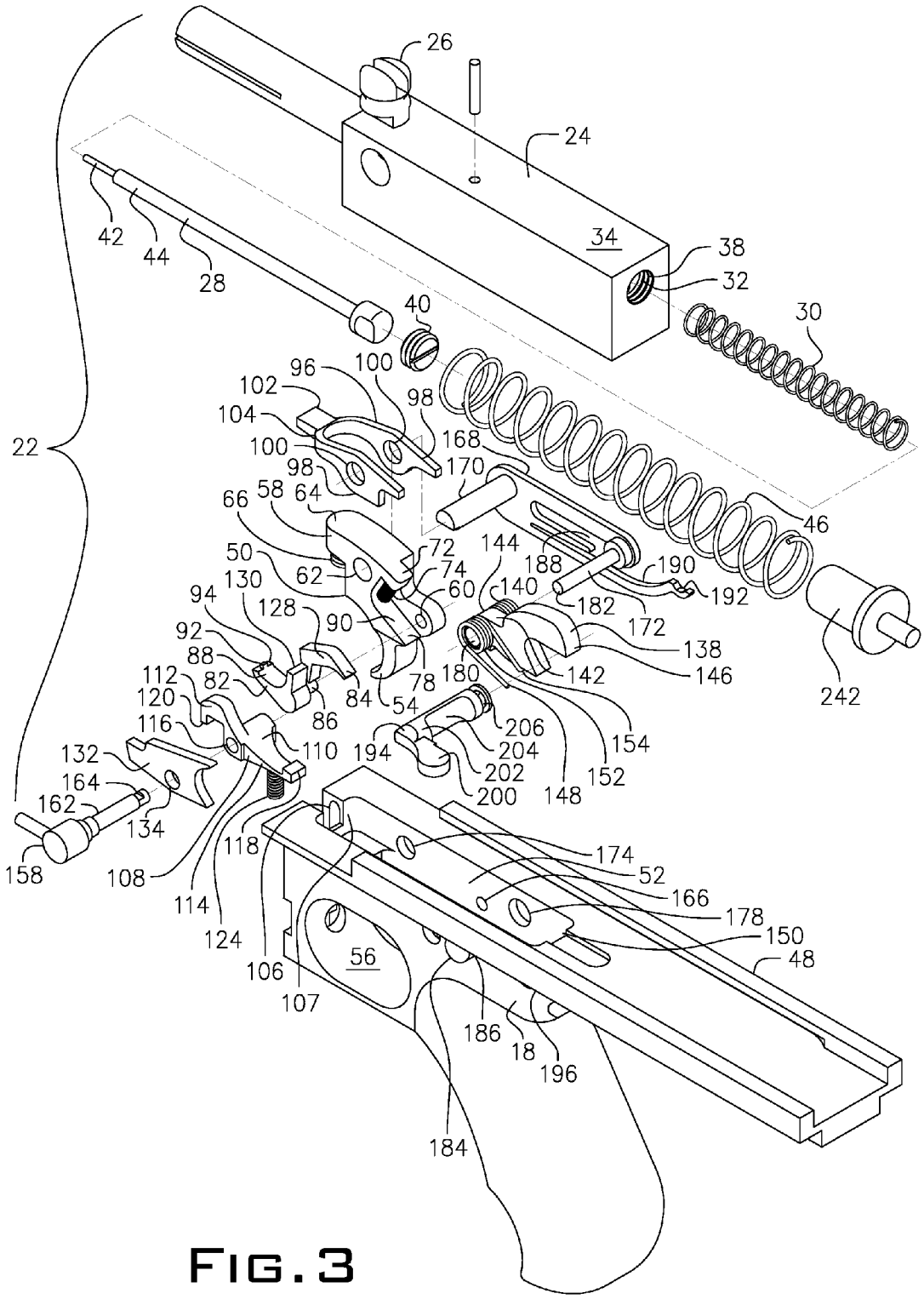
FIG. 3 is an exploded perspective view of the closed bolt system with trigger assembly of the present invention that can be used with a trigger housing from fully automatic submachine gun to convert said gun to a semi-auto firing carbine of which can not be converted back to a fully automatic firing weapon.
Figure 12:
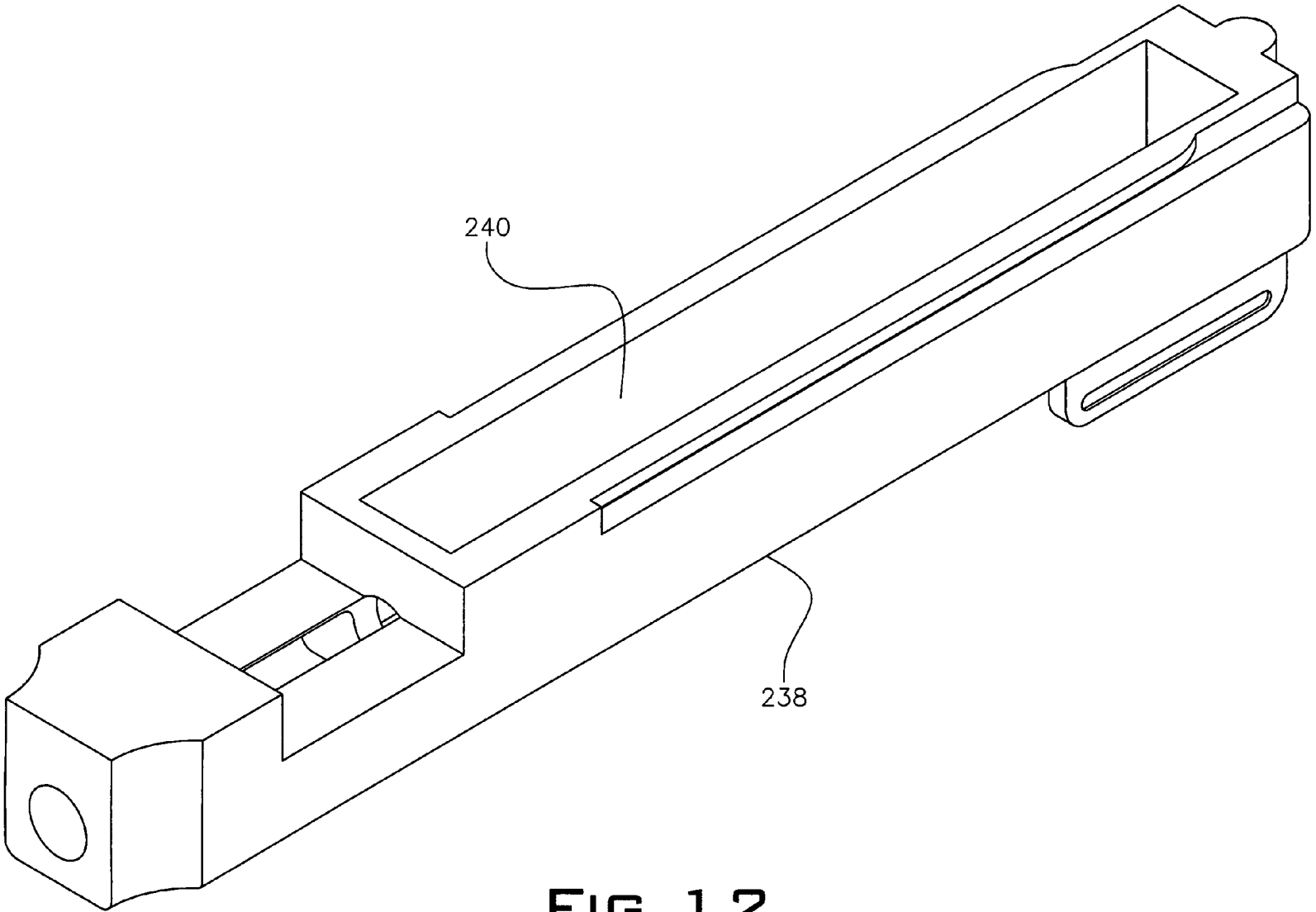
FIG. 12 is a perspective view of the semi-auto receiver employed with the closed bolt system with trigger assembly of the present invention.

Referring now to FIG. 3, the closed bolt system with trigger assembly 22 of the present invention used to convert a fully automatic firing submachine gun into a single firing (semi-auto) carbine is shown in an exploded view (receiver not shown—see FIG. 12). The parts of closed bolt system with trigger assembly 22 include a bolt 24 having a bolt handle 26, a bolt lug 27 (see FIG. 4) and a firing pin 28 tensioned by a firing pin spring 30; both firing pin 28 and firing pin spring 30 are inserted in an axial bore 32 formed through a block portion 34 of bolt 24. Also included is a semi-automatic receiver 238 (see FIG. 12) having a cavity 240 capable of inclosing bolt 24. It is important to note that to make the gun a semi-automatic carbine which is incapable of being converted back to a fully automatic weapon, cavity 240 must be of a size that will not accept a bolt from a fully automatic Thompson. Accordingly, in the preferred embodiment, cavity 240 of semi-auto receiver 238 is made to be one inch and semi-auto bolt 24 is made to be between 0.93 and 0.95 of one inch. And this therefore classifies the weapon as semi-auto according to BATF.

With continuing reference to FIG. 3, axial bore 32 has a constricted but open distal end 36 (see FIG. 4) and a threaded open proximal end 38. A threaded cap 40 screws over threaded open proximal end 38 after firing pin 28 and firing pin spring 30 are inserted in axial bore 32. Further, firing pin 28 has a tip portion 42 that has a smaller circumference than that of a body portion 44 thereof. Firing pin tip portion 42 inserts within constricted distal end 36 of axial bore 32 when firing pin 28 is inserted therein (see FIG. 4 again).

With continuing reference to FIG. 3, it is shown that closed bolt system with trigger assembly 22 also includes a recoil spring 46 positioned behind semi-auto bolt 24 for affecting backward and forward motion of semi-auto bolt 24 during a firing sequence. As spring guide 242 is positioned behind recoil spring 46 to prevent "wading-up" of spring 46 when it is tensioned. Both semi-auto bolt 24 and recoil spring 46 are surrounded by receiver 14 (not shown in FIG. 3, but see FIG. 12). Semi-auto bolt 24 is guided back and forth along a horizontal trigger housing plate 48 extending rearwardly from trigger housing 18. As shown in FIG. 1, semi-auto receiver 14 locks to horizontal trigger housing plate 48, trigger housing 18 as well as to barrel 16 at a front end. Butt stock 12 engages horizontal trigger housing plate 48.

Returning back to FIG. 3, closed bolt system with trigger assembly 22 further includes a trigger 50 positioned within a trigger housing cavity 52 formed in trigger housing 18 and having a finger engagement portion 54 (having a crescent moon-like shape) extending into a modified trigger area 56 of trigger housing 18 below trigger housing cavity 52. An upper portion 58 of trigger 50 rests within cavity 52 and is enclosed therein when trigger 50 is positioned in place. Trigger upper portion 58 has a first and second bore, 60 and 62 respectively, formed therein such that first bore 60 is positioned below and rearwardly of second bore 62 and is slightly offset to a right side thereof and such that a length of first bore 60 is shorter than that of second bore 62. Also, first bore 60 has a slightly smaller circumference than that of second bore 62. Further, trigger upper portion 58 has a convexed-shaped outwardly extending upper ledge portion 64 that includes a trigger spring 66 positioned in a trigger spring cavity 68 formed in a bottom side 70 of ledge portion 64 (see FIG. 4). Trigger upper portion 58 also includes a convexed-shaped rearwardly extending upper ledge portion 72, having a width that is approximately half that of a width of convexed-shaped outwardly extending upper ledge portion 64. A disconnector arm tension spring 74 is intermediately positioned a bottom side 76 of ledge portion 72 (see FIG. 4) and a disconnector arm support ledge 78 formed in trigger upper portion 58. A disconnector arm tension spring cavity 80 (see FIG. 4) is formed in ledge portion bottom side 76 for retaining tension spring 74 by friction therein.

With continuing reference to FIG. 3, it is shown that closed bolt system with trigger assembly 22 also includes a disconnector arm 82 and a disconnector 84 integrally attached at a common axis. An inwardly extending rod member 86 protrudes from a right side from said common axis and inserts within trigger upper portion first bore 60. Both disconnector arm 82 and disconnector 84 have crescent moon-like shapes but of slightly different styles. Disconnector arm 82 has a lower leg portion 88 that rests upon a top surface 90, as shown in see FIGS. 3 and 4, of support ledge 78. A small nipple 92 protrudes upwardly at a distal end 94 of disconnector arm lower leg portion 88 and inserts within a bottom portion of tension spring 74 (see FIG. 4). As will be later discussed and illustrated, tension spring 74 resets disconnector arm 82 after trigger finger engagement portion 54 is released and is integral to prohibiting gun 10 from automatically firing more than one bullet for each pull of the trigger. Disconnector 84 rests above first bore 60 and works to disengage disconnector arm 82 from a sear (to be discussed hereinafter), also assisting in prohibiting gun 10 from automatically firing more than one round for each pull of the trigger. Disconnector 84 is acted upon by semi-auto bolt lug 27 when semi-auto bolt 24 is blown back and tensions disconnector arm 82 against tension spring 74 requiring it to be "reset" before firing another round.

Further to FIG. 3, trip 96 has a pair of downwardly depending opposed side skirts 98 inserting around side walls of trigger upper portion 58. Trip 96 also has a pair of axially aligned apertures 100 formed therethrough that align with trigger upper portion second bore 62. An outwardly extending flat shelf 102 protrudes from a front section 104 of trip 96 and fits within a channel 106 formed at a front end 107 of trigger housing cavity 52. Trip 96 allows a stick magazine empty lug (not shown) to raise shelf 102 for the purpose of holding back semi-auto bolt 24 after the last round has been fired.

Still further to FIG. 3, a sear 108 is provided and has a cylindrical middle portion 110 and an outwardly extending top finger member 112 and rearwardly extending bottom foot member 114. A central bore 116 is formed through sear middle portion 110 thereby intersecting finger member 112 and foot member 114. Finger member 112 has a smaller width than that of middle portion 110 and is offset to a left side of sear 108. Foot member 114 has a varying width that depends from a greater value to a lesser value from middle portion 110 rearwardly. At a distal end of foot member 114, an upstanding wall 118 is provided. Meanwhile, finger member 112 has a downwardly depending tip 120 at its distal end. Further, on a bottom side 122 of foot member 114 (see FIG. 4), a sear tension spring 124 inserts within a bottom bore 126 (also see FIG. 4) formed in trigger housing cavity 52.

Figure 4:
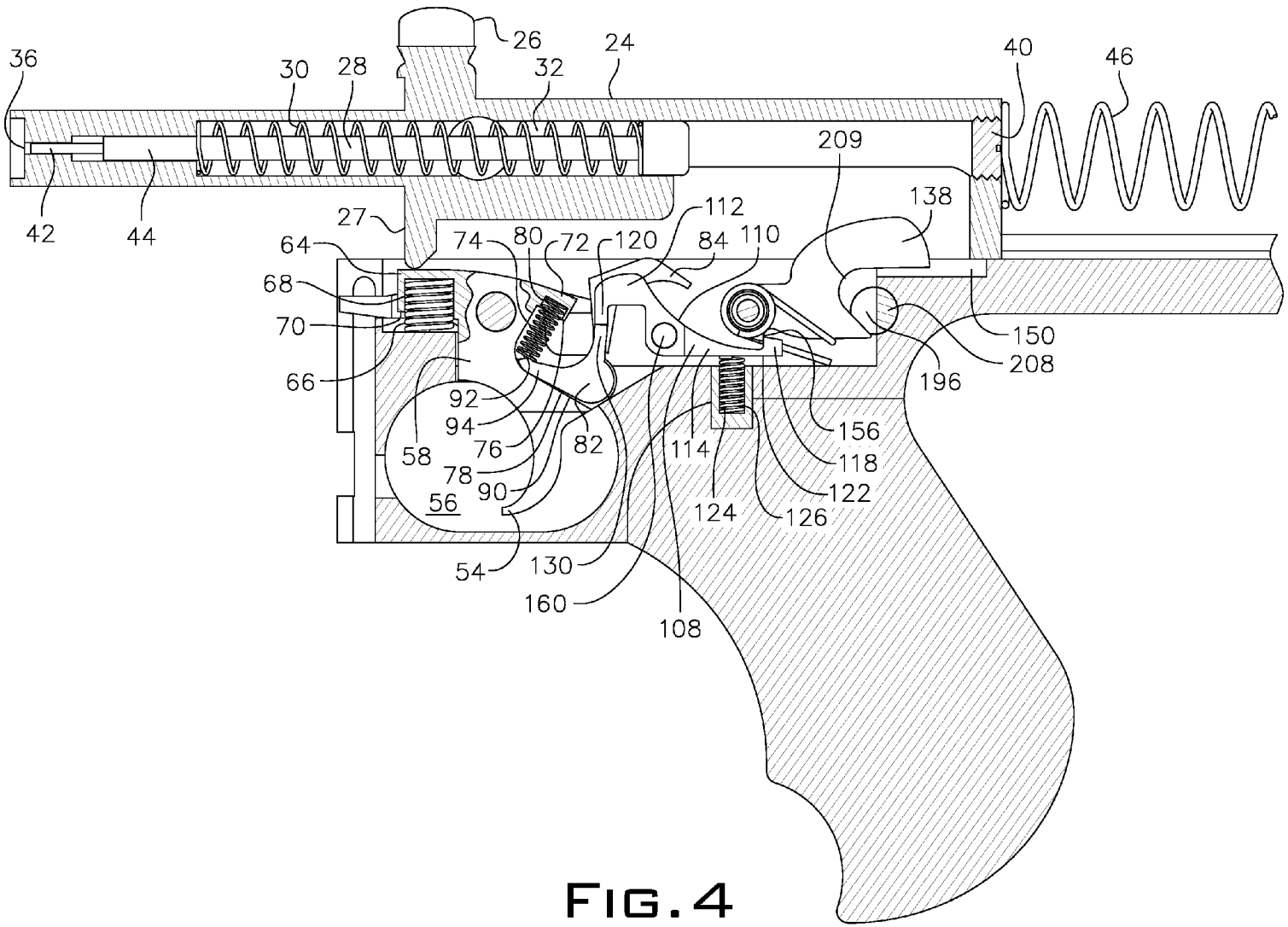
FIG. 4 is a cross-sectional view taken along lines 4-4 of FIG. 2 showing a plurality of inter-connected elements of the closed bolt system with trigger assembly of the present invention prior to a trigger being pulled, showing a hammer as being cocked.

With reference to FIGS. 3 and 4, sear 108 sits within trigger housing cavity 52 slightly behind trigger upper portion 58. Disconnector arm 82 and disconnector 84 have an aggregate width that is equal to that of trigger upper portion 58 and therefore sits flush within trigger upper portion 58 such that opposed outer walls of disconnector arm 82 and disconnector 84 are flush with the opposed side walls of trigger upper portion 58. Since the width of sear middle portion 110 is generally equal to that of trigger upper portion 58 and the width of sear finger member 112 is generally equal to that of disconnector arm 82, sear finger member 112 rests juxtaposed against an inner side wall 128 (see FIG. 3) of disconnector 84 and sear finger member tip 120 rests on top of an upper top wall 130 of disconnector arm 82.

With reference now just to FIG. 3, a vertically disposed bolt hold back pawl 132 is provided for positioning juxtaposed between a left side of sear 108 and an inner left wall of trigger upper portion 58. Bolt hold back pawl 132 has an aperture 134 formed therethough which axially aligns with sear central bore 116.

With continuing reference to FIG. 3, trigger assembly 22 further includes a hammer 138 tensioned by a hammer spring 140. Hammer 138 has a cylindrical portion 142 disposed at a lower front end 144 and a generally c-shaped rearwardly extending striking portion 146 used to slam against firing pin 28 when released from its tensioned state. Hammer spring 140 has a cradle portion 154 for receiving hammer 138, a pair of cylindrical wrappings 152 disposed on opposing ends of hammer cylindrical portion 142 and a pair of support legs 148 extending rearwardly and resting upon the bottom surface of trigger upper portion 58 at a back end 150 thereof. Referring to FIG. 4., hammer 138 also has a downwardly extending nipple 156 disposed underneath cylindrical portion 142 and slightly offset to a rear portion for engaging sear foot member upstanding wall 118. This engagement is what "cocks" the hammer into a "ready fire" position. As will be further described below, disengagement of this contact (see FIGS. 5 and 6) will release hammer 138 and allow it to strike firing pin 28 which in turn fires a round.

All of the aforementioned parts that go into trigger housing assembly 18 are held in place by a series of levers, rods and cams. In particular, bolt hold back pawl 132 and sear 108 are secured by a rocker pivot 158 having a rod portion 162 for inserting through a rocker pivot aperture 160 (see FIG. 4) formed on the left side of gun 10 and through both bolt hold back pawl aperture 134 and sear central bore 116, which are all axially aligned, as shown in FIG. 3. It is noted that in converting a Thompson Submachine Gun, one can utilize the existing rocker pivot and aperture of such gun, eliminating any need to make modifications to trigger housing 18 except to provide for a small channel in trigger housing cavity back end 150 and to provide bottom bore 126 for receiving sear tension spring 124. Of course, since gun 10 is being converted to semi-auto, rocker pivot 158 will no longer select between different firing modes but instead acts as a cam when rotated back to hold semi-auto bolt 24 back. Rocker pivot 158 further includes a notched tip 164 formed in a distal end for protruding from an opposed aperture 166 formed in a right side of trigger housing 18.

Figure 2:
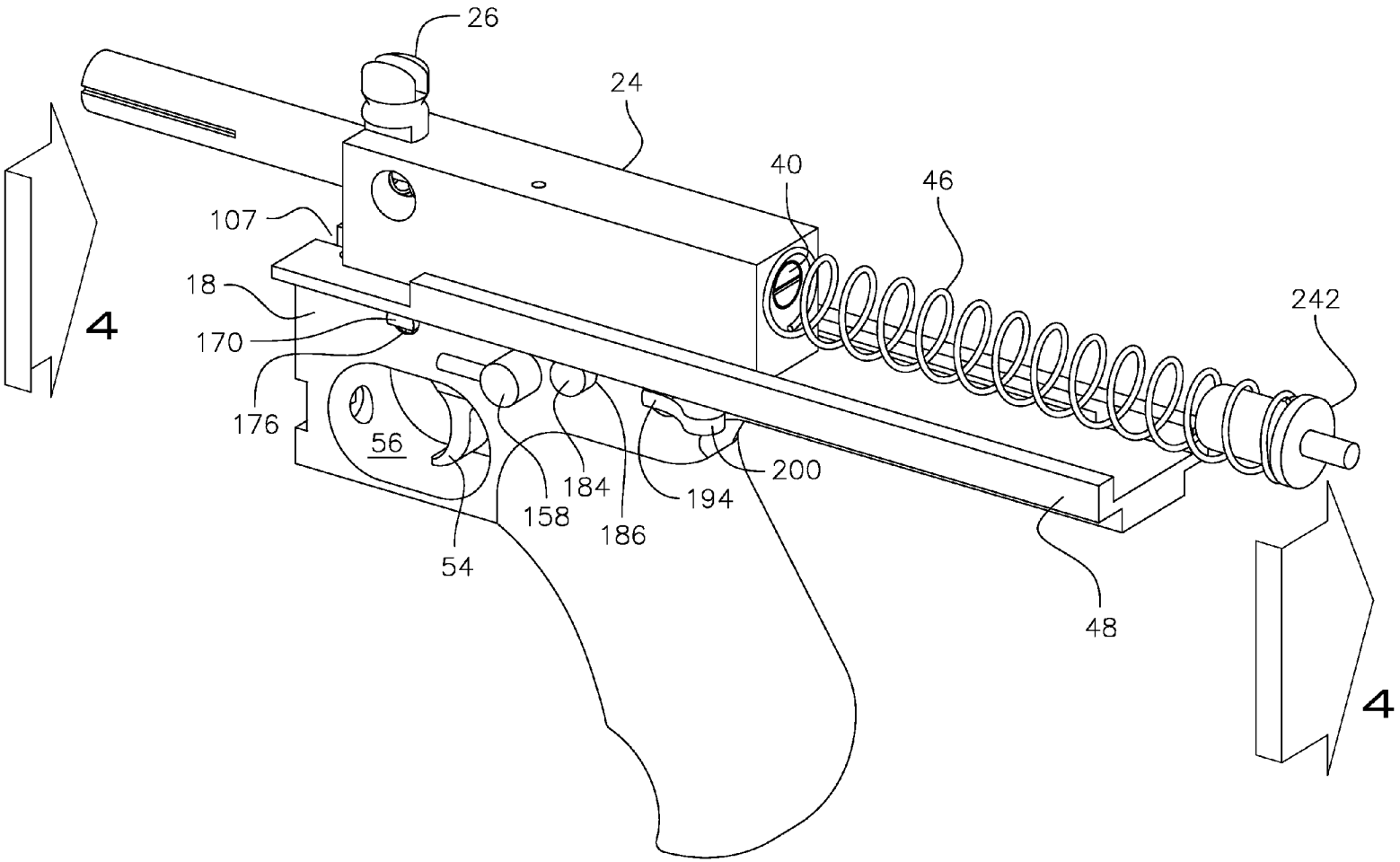
FIG. 2 is a partial perspective view of a submachine gun trigger housing that can be used with the closed bolt system with trigger assembly of the present invention for making the gun a semi-auto carbine.

With continuing reference to FIG. 3, a pivot plate member 168 having first and second inwardly extending posts, 170 and 172 respectively, mounts juxtaposed a right side of trigger housing 18. First inwardly extending post 170 inserts through a first right side aperture 174 formed in the right side of trigger housing 18 securing trip 96 and trigger 50 by intersecting both side skirt apertures 100 of trip 96 and second bore 62 of trigger upper portion 58. A distal end of first inwardly extending post 170 protrudes through a first left side aperture 176 (see FIGS. 1 and 2) formed in the left side of trigger housing 18. Second inwardly extending post 172 inserts through a second right side aperture 178 formed in the right side of trigger housing 18 securing hammer 138 by intersecting a central bore 180 formed in hammer cylindrical portion 142. A distal end 182 of second inwardly extending post 172 is received by a cylindrical cup 184 positioned within a second left side aperture 186 formed in the left side of trigger housing 18. It is noted that in relation to a front and back end of gun 10, first inwardly extending post 170 sits forward of second inwardly extending post 172. Further, both trigger housing first right and left side apertures, 174 and 176 respectively, are located forward, respectively, of both trigger housing second right and left side apertures, 178 and 186 respectively.

Still referring to FIG. 3, it is shown that pivot plate 168 has a generally oblong shape, a cutout portion 188 and a rearwardly extending finger 190 having a knuckled tip portion 192. When rocker pivot 158 is inserted through aperture 134 to secure bolt hold back pawl 132 and sear 108, rod portion notch 164 protrudes through opposed aperture 166 and engages pivot plate 168 along finger 190. This assists in retaining pivot plate 168 flush against the right side of trigger housing 18.

With continuing reference to FIG. 3, a safety lever 194 is provided for locking hammer 138 when it is in a "cocked" (ready to fire) position. Safety lever 194 inserts through a left rear aperture 196 formed in the left side of trigger housing 18 proximal to the back end of gun 10 nearest to butt stock 12 and protruding out of a right rear aperture (not shown) formed in the right side of trigger housing 18. Safety lever 194 includes an external knob 200, a rod portion 202 having a cutaway portion 204 and a distal tip having a circular groove 206 formed therein engaging knuckled tip 192 when the safety lever rod portion distal tip extends through right rear aperture. Groove 206 engaging knuckled tip 192 also assists in securing pivot plate 168 flush against the right side of trigger housing 18.

Figure 6:
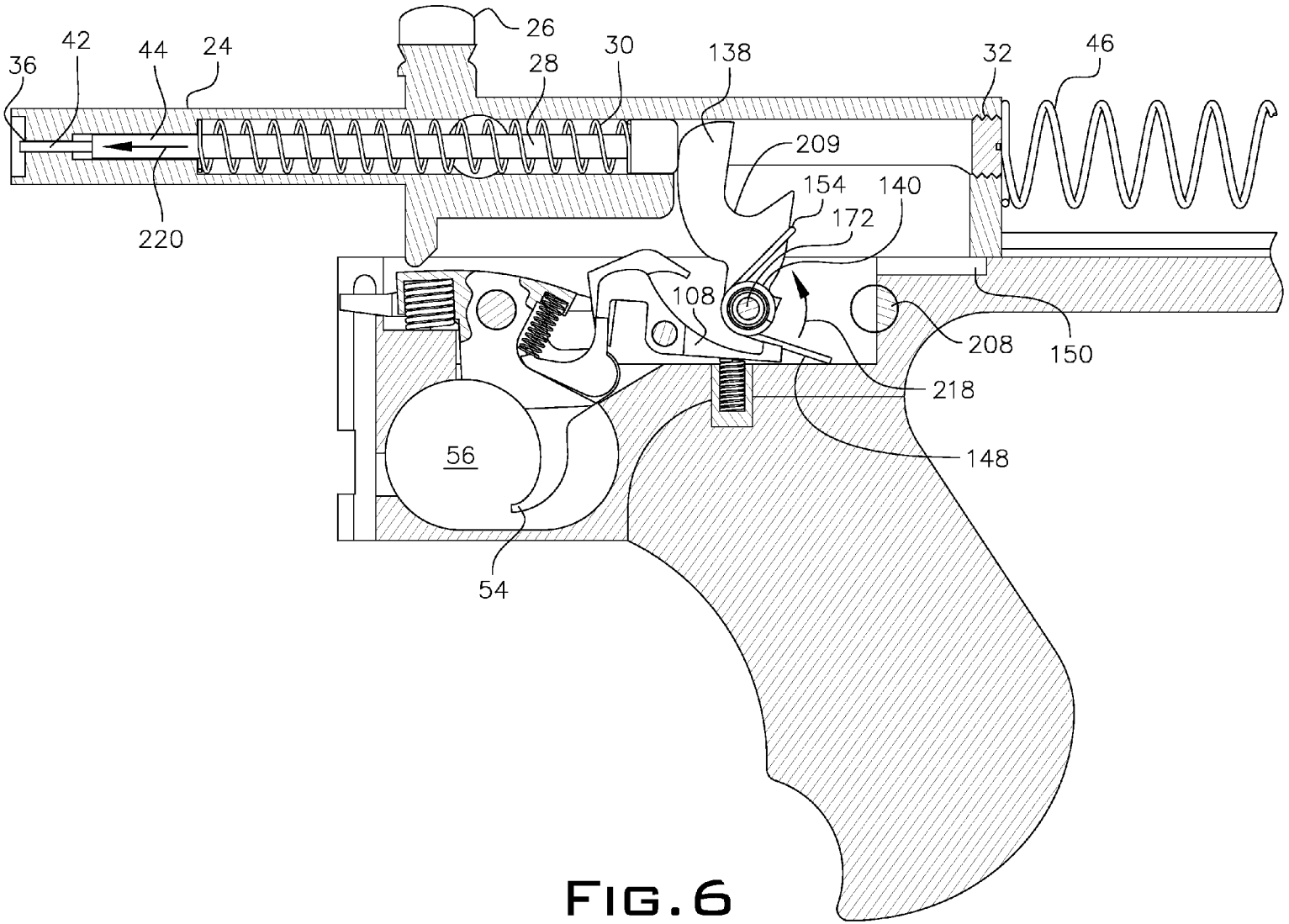
FIG. 6 is a cross-sectional view taken along lines 4-4 of FIG. 2 showing the plurality of inter-connected elements of the closed bolt system with trigger assembly as the released hammer is striking a firing pin of the bolt located inside the semi-auto receiver of a weapon in which my invention is employed.
Figure 10:
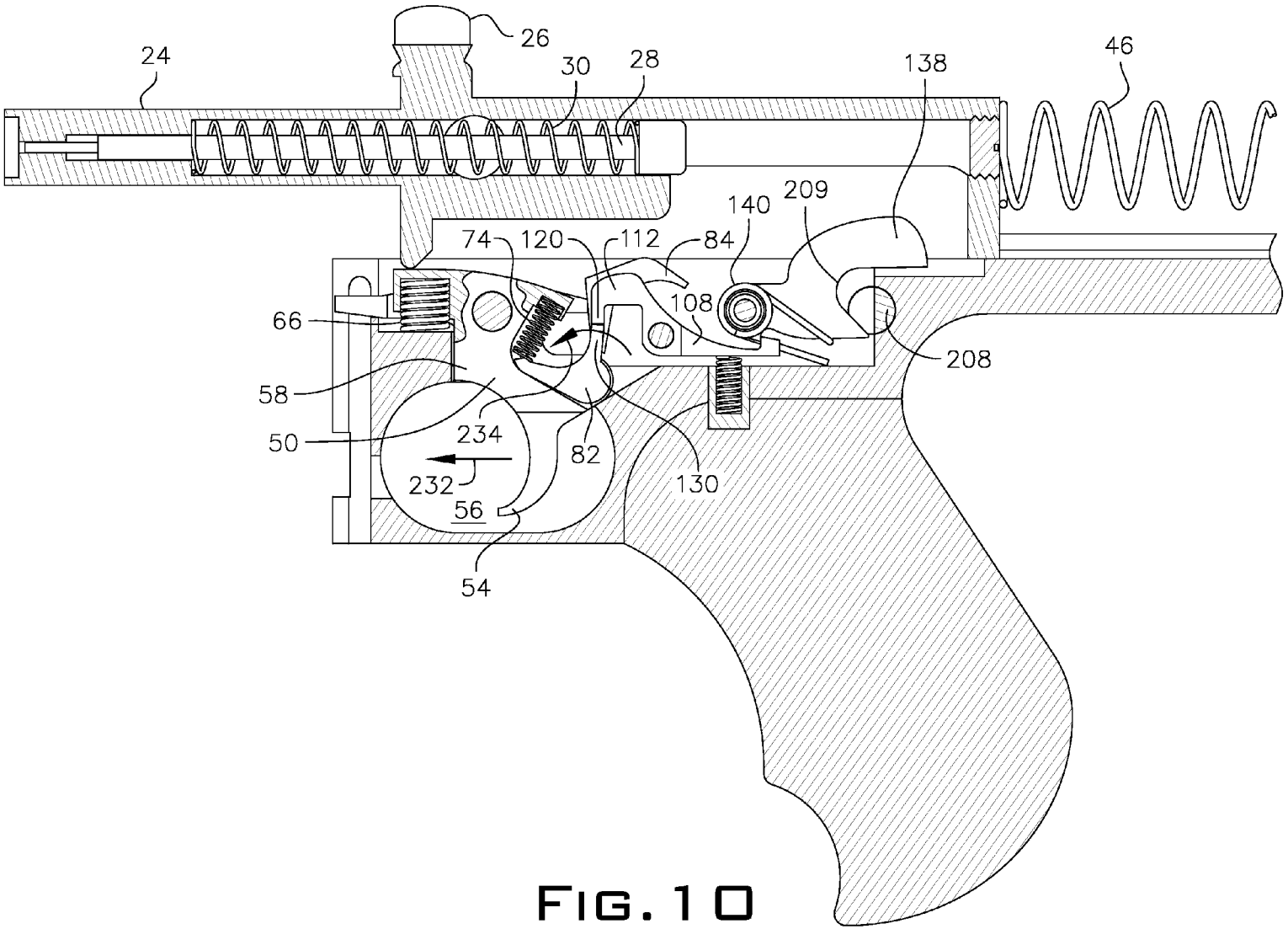
FIG. 10 is a cross-sectional view taken along lines 4-4 of FIG. 2 showing how the plurality of inter-connected elements of the closed bolt system with trigger assembly return to a "ready to fire" position when the bolt has reached its forward limit.

Referring now to FIGS. 4, 6 and 10, it is shown that safety lever 194 can be placed in two distinct states. A first state allows hammer 138 to release when trigger 50 is engaged and is therefore considered "ready-fire" (see FIG. 4 and 6). In a second state, hammer 138 is locked by rotating safety lever 194 to the rear which places gun 10 in "safe", prohibiting the firing of a round (see FIG. 10). The solid part of rod portion 202 acts as a cam 208 and draws down hammer 138 off of sear 108 by pushing on a back area 209 behind c-shaped striking portion 146 of hammer 138.

As previously mentioned, closed bolt system with trigger assembly 22 can be installed into a fully automatic submachine gun for converting it to a semi-automatic firing carbine. By doing so, closed bolt system with trigger assembly 22 permits the firing of a single round for each pull of the trigger and prohibits a fully automatic firing mode. In the preferred embodiment, closed bolt system with trigger assembly 22 is used to convert a blowback, open bolt type weapon, such as a Thompson Submachine gun to a semi-auto carbine.

Referring to FIG. 4, closed bolt system with trigger assembly 22 is installed in a blowback style firearm. As shown, hammer 138 is in a "ready fire" position also known as being cocked. As such, as can be appreciated, trigger spring 66, disconnector arm tension spring 74 and sear tension spring 124 are all in their respective relaxed states. Further, downwardly depending tip 120 of sear finger member 112 is in contact with disconnector arm upper top wall 130. Further, disconnector arm 82 rests upon trigger upper portion disconnector arm support ledge 78. Still further, downwardly extending nipple 156 of hammer 138 is in contact (engaging) upwardly standing wall 118 of sear 108. This engagement prohibits hammer 138 from releasing from its tensioned state with hammer spring 140. As further shown, cam 208 is not engaging hammer 138, therefore gun 10 is not in a safety mode. Gun 10 is placed in this "ready fire" position by first placing a loaded magazine (not shown in FIG. 4) into a magazine receptacle. Then, bolt 24 is drawn back by hand by pulling on bolt handle 26 against recoil spring 46. Since an open bolt system is used in the preferred embodiment, a cartridge is stripped from the magazine and loaded into the chamber. The drawing back of bolt 24 also pushes down hammer 138 and acts upon disconnector 84 (to be discussed in further detail hereinafter) to place all parts into their respective depicted positions shown in FIG. 4.

Figure 5:
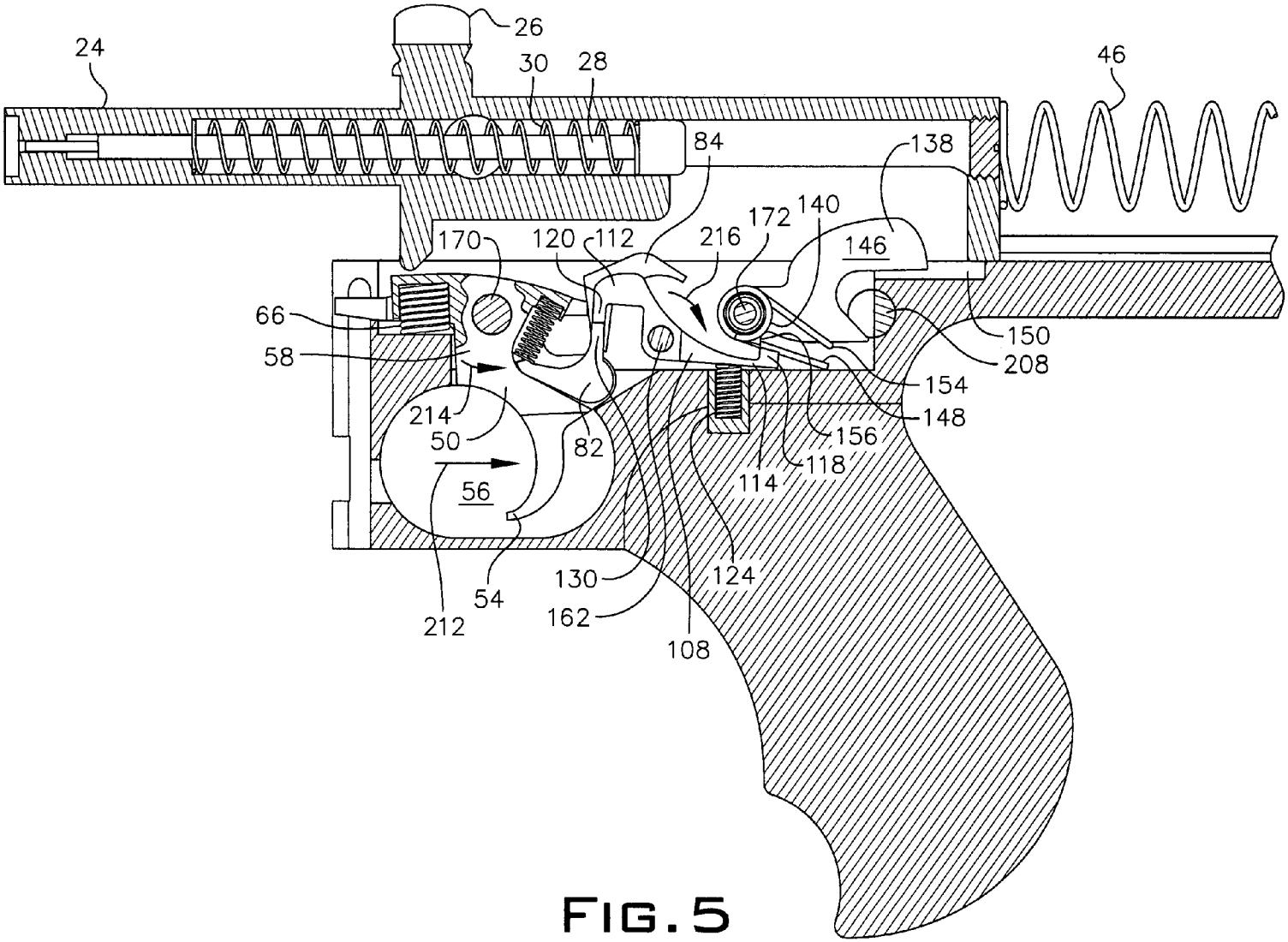
FIG. 5 is a cross-sectional view taken along lines 4-4 of FIG. 2 showing the plurality of inter-connected elements of the closed bolt system with trigger assembly just as the trigger is being pulled and showing how a disconnector arm, a disconnector and a sear all operate to release the cocked hammer.

FIG. 5 illustrates what occurs when the trigger is pulled. First, trigger finger engagement portion 54 is pulled backwards by a person's finger in the direction of arrow 212. This causes trigger upper portion 58 to tension trigger spring 66 and to rotate, counter-clockwise, about first inward extending post 170 as shown by arrow 214. This in turn pushes disconnector arm 82 upwards thereby causing upper top wall 130 to push up on sear downwardly depending tip 120. This action causes sear 108 to tension sear spring 124 by rotating, clockwise, about selector rocker pivot rod portion 162, as shown by arrow 216, further disengaging sear foot member upstanding wall 118 from downwardly depending nipple 156 of hammer 138.

Referring to FIG. 6, hammer 138 is released from its tensioned state by hammer spring 140 and rotates, counter-clockwise, about second inward extending post 172 of pivot plate 168, as shown by arrow 218. Hammer 138 strikes firing pin 28 causing it to move forward as shown by arrow 220, which then causes firing pin tip 42 to protrude out of open distal end 36 of axial bore 32 making contact with a primer of a cartridge (not shown) and firing a round.

Figure 7:
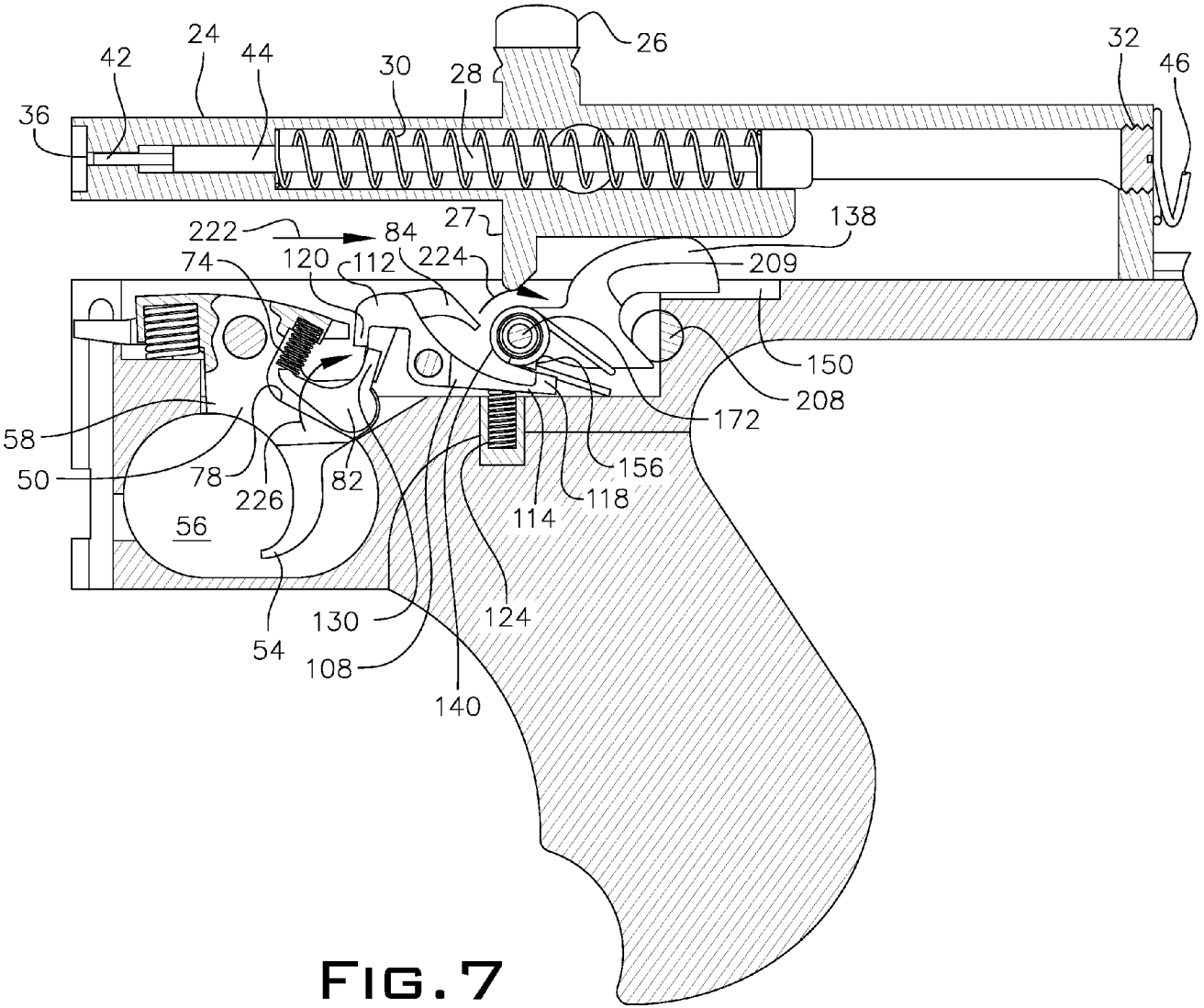
FIG. 7 is a cross-sectional view taken along lines 4-4 of FIG. 2 showing the plurality of inter-connected elements of the closed bolt system with trigger assembly as the bolt is "blowing" backwards within the semi-auto receiver and acting upon said plurality of trigger assembly elements.

Referring now to FIG. 7, the result of the cartridge exploding causes the release of rapidly expanding gases that first pushes the bullet out of the front of the barrel. Bolt 24 "blows back", against recoil spring 46, also due to the expanding gases inside of the chamber, but at a slower rate than that of the bullet exiting the barrel due to a great differential in inertia therebetween. As bolt 24 blows back, in a direction indicated by arrow 222, it acts upon hammer 138 by pushing it down thereby and rotating it, clockwise, about second inward extending post 172, as shown by arrow 224. At about the same time, bolt lug 27 acts upon disconnector 84 by pushing it down and rotating both disconnector 84 and disconnector arm 82, clockwise, about inwardly extending rod member 86, as shown by arrow 226, and tensioning disconnector arm 82 against disconnector arm tension spring 74 and also disengaging disconnector upper top wall 130 from sear downwardly depending tip 120. It is noted that at this moment in time, disconnector arm 82 is slightly lifted up from trigger upper portion disconnector arm support ledge 78.

Figure 8:
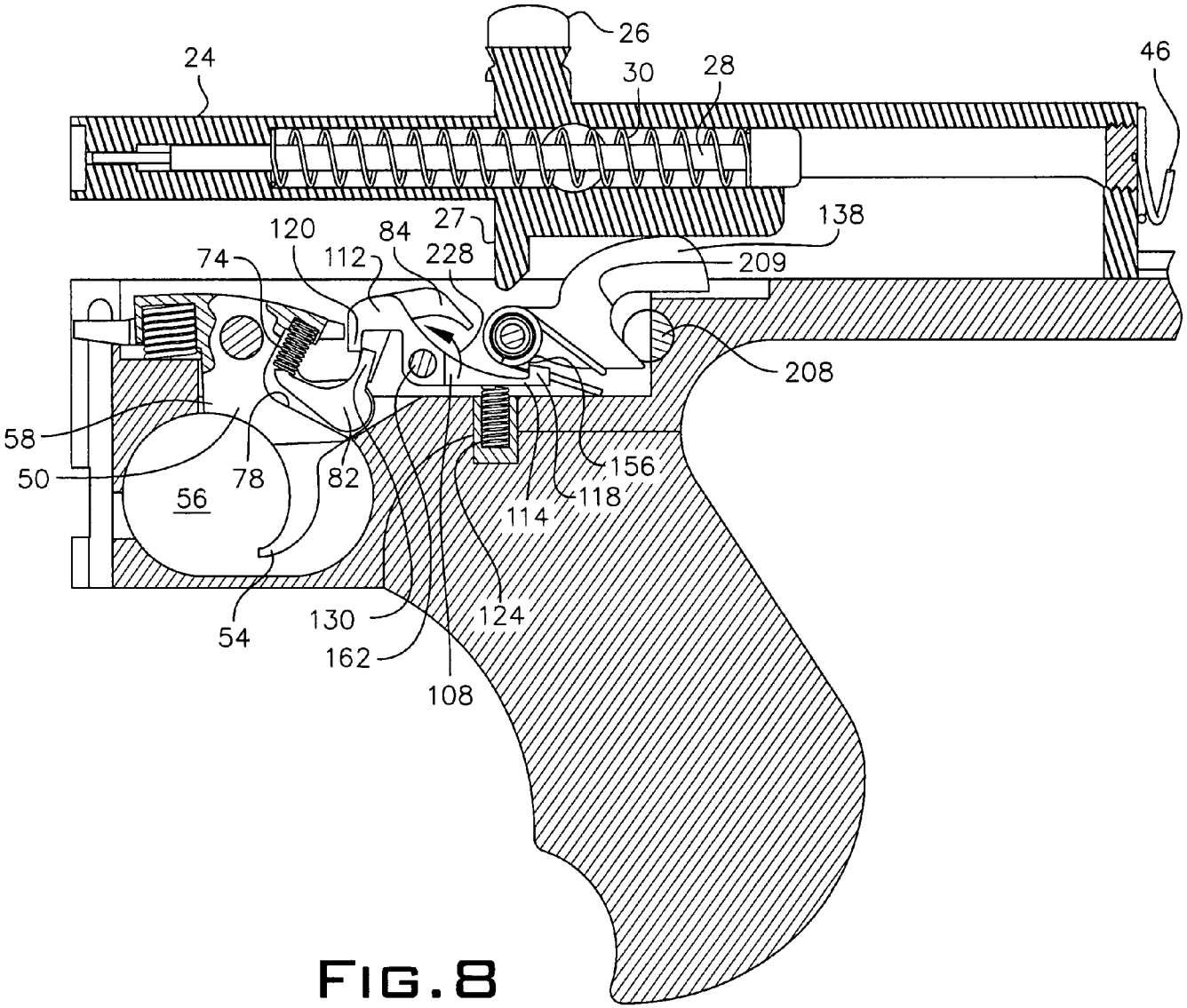
FIG. 8 is a cross-sectional view taken along lines 4-4 of FIG. 2 showing the plurality of inter-connected elements of the closed bolt system of the trigger assembly just as the bolt has reached its backwards limit and has momentarily stopped before being pushed forward by the recoil spring mounted behind said bolt, and said bolt having reached its backwards limit allowing a new cartridge to be stripped into the firing chamber from an attached magazine or drum.

FIG. 8 illustrates a moment in time where bolt 24 has reached its backward limit but has not yet begun to spring back forward. At his moment, disconnector arm 82 has been tensioned against disconnector arm tension spring 74 due to disconnector 84 being passed over by bolt lug 27. Further, hammer 138 remains tensioned against hammer tension spring 140 due to the position of bolt 24 applying pressure downward thereupon. However, sear 108 is allowed to rotate, counter-clockwise, about selector switch rod portion 162, as shown by arrow 228, since sear finger downwardly depending tip 120 is disengaged from disconnector arm upper top wall 130. Sear 108 rotation is affected by sear spring 124 releasing its tensioned state. As a result, sear foot member upstanding wall 118 re-engages hammer downwardly depending nipple 156 and "re-cocks" hammer 138 to ready fire.

Figure 9:
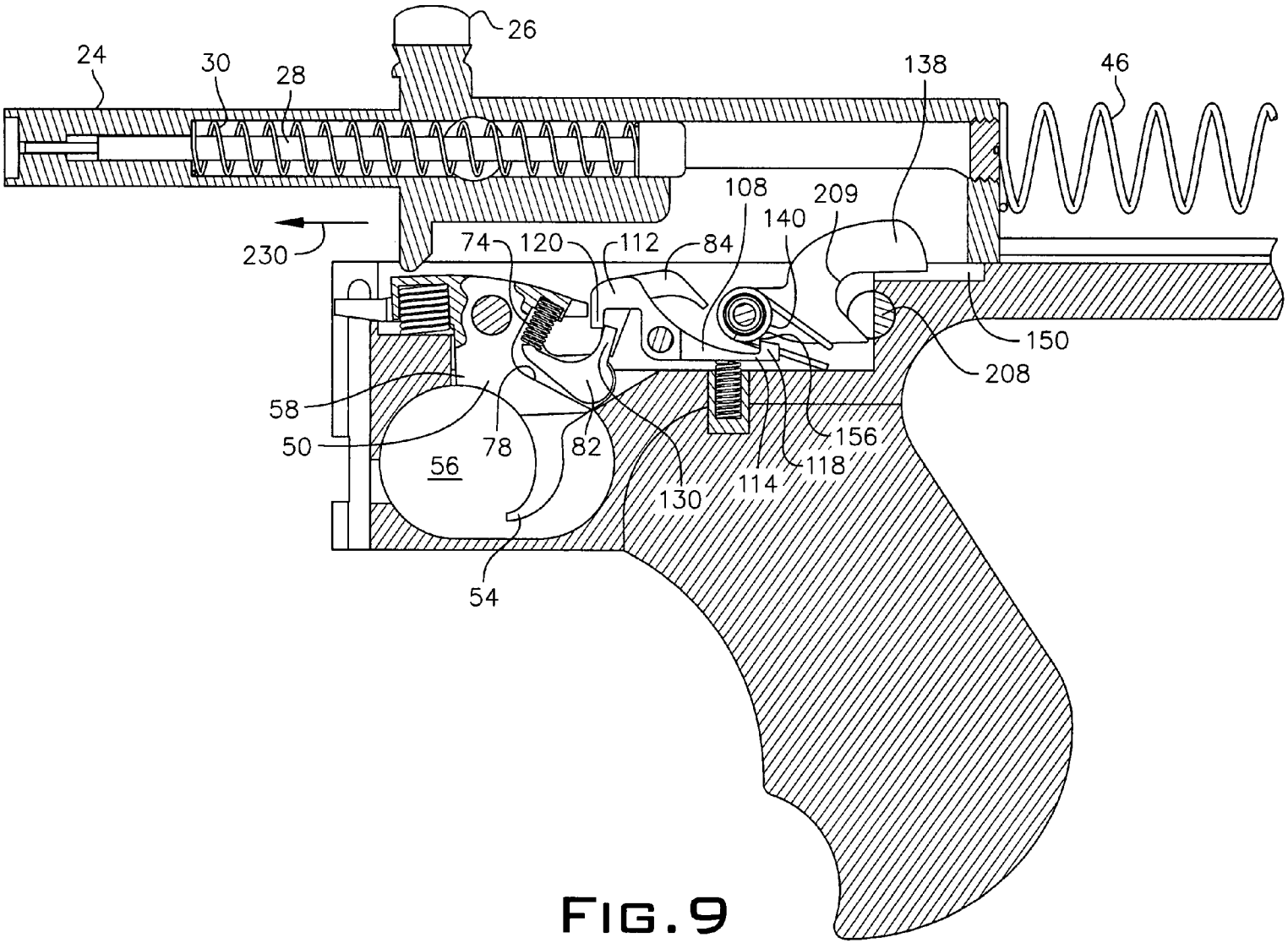
FIG. 9 is a is a cross-sectional view taken along lines 4-4 of FIG. 2 showing the plurality of inter-connected elements of the closed bolt system with trigger assembly as the bolt is springing forwards, showing how the hammer remains cocked and prohibited from re-striking the firing pin.

Referring to FIG. 9, bolt 24 moves forward in a direction illustrated by arrow 230, due to recoil spring 46 releasing its tensioned state. However, hammer 138 is prohibited from re-striking firing pin 28 at this time due to the nipple 156—upstanding wall 118 engagement. Hammer 138 is re-tensioned, however, by hammer spring 140 and is considered "cocked."

Referring to FIG. 10, pressure upon trigger finger engagement portion 54 is released allowing it to move forward in a direction indicated by arrow 232. In doing such, trigger upper portion 58 is released from its tensioned state causing both trigger spring 66 and disconnector arm tension spring 74 to relax. This causes disconnector arm 82 and disconnector 84 to rotate, counter-clockwise, about its axis (rod 86), as shown by arrow 234. As disconnector arm 82 rotates, it "resets" by engaging disconnector arm upper top wall 130 with sear downwardly depending tip 120. Now, gun 10 is ready to fire again upon the re-pulling of the trigger. If trigger 50 is not let go, then this "resetting" procedure can not occur and accordingly prohibits sear 108 from disengaging with hammer 138. However, it should be appreciated that the entire firing process, one pull of the trigger and then its release can still happen very quickly. In fact, everything that happens as described from FIGS. 5-10 can occur within one second. But under no circumstances, can a second round be fired without first releasing trigger 50 and allowing the "reset" of disconnector arm 82 with sear 108.

Figure 11:
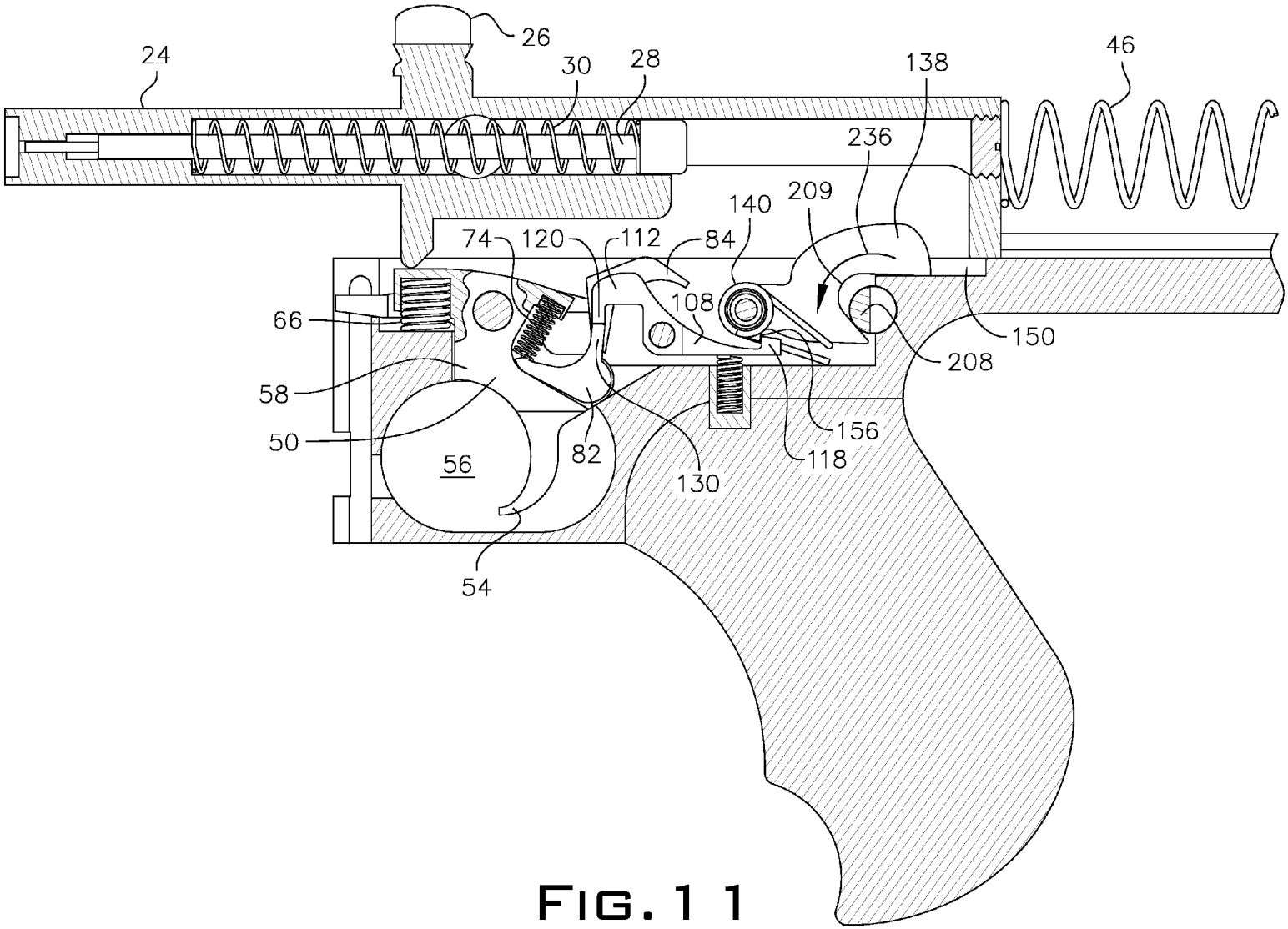
FIG. 11 is a cross-sectional view taken along lines 4-4 of FIG. 2 showing how the trigger can be drawn off the sear by a safety cam for placing the gun in a safety mode (non-firing) or for disassembling the gun.

Referring to FIG. 11, a safety cam 208 is provided. Cam 208 is a part of rod 202 of safety lever 194. In ready fire (FIGS. 4-10), lever 194 is rotated such that cam 208 does not interfere with the movement of hammer 138. However, in the safety mode of FIG. 11, cam 208 rotates, counter-clockwise, as indicated by arrow 236, and engages a back side 209 of hammer 138. This action draws hammer 138 down upon trigger housing cavity back end 150 and separates hammer downwardly depending nipple 156 from sear upstanding wall 118. In the safety mode, hammer 138 can not strike firing pin 28. Further, in the safety mode, gun 10 can be disassembled.

Referring to FIG. 12, semi-auto receiver 238 is shown and has, in a preferred embodiment, a cavity 240 having a width of one inch. This accommodates semi-auto bolt 24 and prohibits a fully automatic bolt from being used therewith. In the preferred embodiment, semi-auto bolt 24 is between 0.93 to 0.95 inches.

Equivalent elements can be substituted for ones set forth herein to achieve the same results in the same way and in the same manner.

Having thus described the present invention in the detailed description of the preferred embodiment, what is desired to be obtained in Letters Patent is:

1. A closed bolt system with trigger assembly for converting a fully automatic firing submachine gun into a semi-automatic firing carbine, the gun having a barrel and a trigger housing, the closed bolt system with trigger assembly comprising:

a) a bolt having a bolt lug disposed along a bottom side thereof and an axial bore formed therein, the axial bore receiving a firing pin tensioned by a spring, the firing pin having a tip portion at a front end extendable out of an open front end of the bolt and a rear wall at a back end for receiving contact by a tensioned hammer, the gun receiver enclosing the bolt;

b) a trigger member inserted within a cavity formed in the trigger housing, the trigger member having a finger engagement portion extending through the cavity into a trigger area of the trigger housing, the trigger member further having an upper portion for supporting an integral disconnector system;

c) the integral disconnector system including a disconnector arm and a disconnector, the disconnector arm having an upper top wall affecting the trigger assembly when the finger engagement portion of the trigger member is pulled backwards;

d) a tensioned sear having a finger member in contact with the disconnector arm upper top wall and a foot member for engaging the hammer;

e) the hammer having a nipple for engaging the sear foot member, the hammer tensioned by a spring and striking the firing pin when disengaged from the sear foot member;

f) a recoil spring positioned rearwardly of the bolt affecting backward and forward movement of the bolt;

g) a receiver for enclosing the bolt;

h) a pivot plate member having first and second inwardly extending posts;

i) a plurality of apertures formed in left and right sides of the gun trigger housing;

j) the trigger member upper portion having a second bore formed therein;

k) the hammer having a cylindrical portion and a central bore formed therethrough; and l) the pivot plate first inwardly extending post inserted through at least one of the plurality of apertures formed in the gun trigger housing and securing the trigger member within the trigger housing cavity through the trigger member upper portion second bore and the pivot plate second inwardly extending post inserted through at least one of the plurality of apertures formed in the gun trigger housing and securing the hammer within the trigger housing cavity through the hammer central bore.

2. The closed bolt system with trigger assembly of claim 1, wherein the bolt re-engages the hammer nipple with the sear foot member and disengages the sear finger member from the disconnector arm upper top wall when the bolt moves backwards, the disengagement of the sear finger from the disconnector arm upper top wall prohibiting the gun from firing.

3. The closed bolt system with trigger assembly of claim 2, wherein the sear finger member re-engages the disconnector arm upper top wall only after the trigger member finger engagement portion is released.

4. The closed bolt system with trigger assembly of claim 1, wherein the fully automatic firing submachine gun is an open bolt, blowback cycling weapon.

5. The closed bolt system with trigger assembly of claim 1, further comprising the trigger member including a support ledge for positioning the disconnector arm thereupon.

6. The closed bolt system with trigger assembly of claim 5, further comprising:

a) a front and rear ledge of the trigger member upper portion;

b) a trigger member tension spring mounted below the front ledge and tensioned when the trigger member finger engagement portion is pulled; and c) a disconnector arm tension spring intermediately disposed the second ledge and the support ledge of the trigger member upper portion, the disconnector arm tension spring tensioning the disconnector arm when the bolt blows backwards.

7. The closed bolt system with trigger assembly of claim 6, wherein the disconnector arm tension spring un-tensions the disconnector arm only after the finger engagement portion of the trigger member is released.

8. The closed bolt system with trigger assembly of claim 1, further comprising the disconnector arm and disconnector integrally attached at a common axis, the common axis including an inwardly extending rod portion for inserting within a first bore formed in the trigger member upper portion.

9. The closed bolt system with trigger assembly of claim 1, further comprising the sear having a downwardly depending tip of the finger member and an upwardly extending wall of the foot member.

10. The closed bolt system with trigger assembly of claim 9, wherein the semi-automatic carbine is in a ready fire mode when the disconnector arm upper top wall engages the sear finger member downwardly depending tip.

11. The closed bolt system with trigger assembly of claim 9, wherein the semi-automatic carbine is prohibited from firing a round when the disconnector arm upper top wall is disengaged from the sear finger member downwardly depending tip.

12. The closed bolt system with trigger assembly of claim 9, wherein the carbine is cocked and ready to fire when the hammer nipple is engaging the sear foot member upstanding wall.

13. The closed bolt system with trigger assembly of claim 1, further comprising a safety lever having a rod portion supporting a cam, the cam rotatable onto a back side of the hammer for drawing the hammer down and disengaging it from the sear.

14. A closed bolt system with trigger assembly for converting a fully automatic firing submachine gun into a semi-automatic firing carbine, the gun having a barrel and a trigger housing, the closed bolt system with trigger assembly comprising:

a) a bolt having a bolt lug disposed along a bottom side thereof and an axial bore formed therein, the axial bore receiving a firing pin tensioned by a spring, the firing pin having a tip portion at a front end extendable out of an open front end of the bolt and a rear wall at a back end for receiving contact by a tensioned hammer, the gun receiver enclosing the bolt;

b) a trigger member inserted within a cavity formed in the trigger housing, the trigger member having a finger engagement portion extending through the cavity into a trigger area of the trigger housing, the trigger member further having an upper portion for supporting an integral disconnector system;

c) the integral disconnector system including a disconnector arm and a disconnector, the disconnector arm having an upper top wall affecting the trigger assembly when the finger engagement portion of the trigger member is pulled backwards;

d) a tensioned sear having a finger member in contact with the disconnector arm upper top wall and a foot member for engaging the hammer;

e) the hammer having a nipple for engaging the sear foot member, the hammer tensioned by a spring and striking the firing pin when disengaged from the sear foot member;

f) a recoil spring positioned rearwardly of the bolt affecting backward and forward movement of the bolt;

g) a receiver for enclosing the bolt;

h) a rocker pivot having a rod portion and a notched tip;

i) first and second rocker pivot apertures formed in a left and right side, respectively, of the gun trigger housing;

j) the sear having a middle portion separating the finger and foot members and a central bore formed therein;

k) the rocker pivot rod inserting through the first rocker pivot aperture, the sear middle portion central bore and the second rocker pivot aperture; and l) the rocker pivot notched tip engaging a pivot plate positioned on an opposed side thereof.

15. A closed bolt system with trigger assembly for converting a fully automatic firing submachine gun into a semi-automatic firing carbine, the submachine gun having a barrel, a trigger housing and a horizontal plate member for supporting a semi-auto receiver, the submachine gun operating under a blowback cycling system, the closed bolt system with trigger assembly comprising:

a) a bolt having a bolt lug disposed along a bottom side thereof and an axial bore formed therein, the axial bore receiving a firing pin tensioned by a spring, the firing pin having a tip portion at a front end extendable out of an open front end of the bolt and a rear wall at a back end for receiving contact by a tensioned hammer;

b) a trigger member inserted within a cavity formed in the trigger housing, the trigger member having a finger engagement portion extending through the cavity into a trigger area of the trigger housing, the trigger member further having an upper portion with a support ledge for supporting an integral disconnector system;

c) the integral disconnector system including a disconnector arm and a disconnector, the disconnector arm having an upper top wall affecting the trigger assembly when the finger engagement portion of the trigger member is pulled backwards, the disconnector arm resting on the trigger member upper portion support ledge;

d) a tensioned sear having a finger member in contact with the disconnector arm upper top wall and a foot member for engaging the hammer;

e) the hammer having a nipple for engaging the sear foot member, the hammer tensioned by a spring and striking the firing pin when disengaged from the sear foot member; and f) a recoil spring positioned rearwardly of the bolt affecting backward and forward movement of the bolt;

g) a spring guide mounted behind the recoil spring to prohibit the recoil spring from wading up when in a tensioned state;

h) a semi-auto receiver enclosing the bolt over the trigger housing when attached to the horizontal plate member of the trigger housing;

i) a pivot plate member having first and second inwardly extending posts;

j) a plurality of apertures formed in left and right sides of the gun trigger housing;

k) the trigger member upper portion having a second bore formed therein;

l) the hammer having a cylindrical portion and a central bore formed therethrough; and m) the pivot plate first inwardly extending post inserted through at least one of the plurality of apertures formed in the gun trigger housing and securing the trigger member within the trigger housing cavity through the trigger member upper portion second bore and the pivot plate second inwardly post inserted through at least one of the plurality of apertures formed in the gun trigger housing and securing the hammer within the trigger housing cavity through the hammer central bore.

16. The closed bolt system with trigger assembly of claim 15, wherein the submachine gun is a Thompson Submachine Gun.

17. The closed bolt system with trigger assembly of claim 15, further comprising the disconnector arm and disconnector integrally attached at a common axis, the common axis including an inwardly extending rod portion for inserting within a first bore formed in the trigger member upper portion.

18. The closed bolt system with trigger assembly of claim 15, further comprising the sear having a downwardly depending tip of the finger member and an upwardly extending wall of the foot member.

19. The closed bolt system with trigger assembly of claim 15, further comprising:

a) a rocker pivot having a rod portion and a notched tip;

b) first and second rocker pivot apertures formed in a left and right side, respectively, of the gun trigger housing;

c) the sear having a middle portion separating the finger and foot members and a central bore formed therein;

d) the rocker pivot rod portion inserting through the first rocker pivot aperture, the sear middle portion central bore and the second rocker pivot aperture; and e) the rocker pivot notched tip engaging a pivot plate disposed on an opposed side therefrom.

20. The closed bolt system with trigger assembly of claim 15, further comprising:

a) a front and rear ledge of the trigger member upper portion;

b) a trigger member tension spring mounted below the front ledge and tensioned when the trigger member finger engagement portion is pulled; and c) a disconnector arm tension spring intermediately disposed the second ledge and support ledge of the trigger member upper portion, the disconnector arm tension spring tensioning the disconnector arm when the bolt blows backwards.

21. The closed bolt system with trigger assembly of claim 20, wherein the disconnector arm tension spring un-tensions the disconnector arm only after the finger engagement portion of the trigger member is released.

22. The closed bolt system with trigger assembly of claim 15, further comprising a safety lever having a rod portion supporting a cam, the cam rotatable onto a back side of the hammer for drawing the hammer down and disengaging it from the sear.

* * * * *